US008873986B2

(12) United States Patent
Chiyoda

(10) Patent No.: US 8,873,986 B2
(45) Date of Patent: Oct. 28, 2014

(54) IMAGE HEATING APPARATUS

(71) Applicant: Canon Kabushiki Kaisha, Tokyo (JP)

(72) Inventor: Yasuharu Chiyoda, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 43 days.

(21) Appl. No.: 13/654,799

(22) Filed: Oct. 18, 2012

(65) Prior Publication Data

US 2013/0108298 A1 May 2, 2013

(30) Foreign Application Priority Data

Oct. 27, 2011 (JP) ..... 2011-236151

(51) Int. Cl.
*G03G 15/20* (2006.01)

(52) U.S. Cl.
CPC .. *G03G 15/2028* (2013.01); *G03G 2215/00772* (2013.01)
USPC ..... 399/69; 399/323

(58) Field of Classification Search
CPC ..... G03G 15/20; G03G 21/20
USPC ..... 399/69, 92, 323, 328, 329, 33; 219/216, 219/482–494
See application file for complete search history.

(56) References Cited

U.S. PATENT DOCUMENTS

| | | | | |
|---|---|---|---|---|
| 5,315,350 | A * | 5/1994 | Hirobe et al. | 399/69 |
| 5,682,577 | A * | 10/1997 | Kiyoi | 399/69 |
| 6,016,410 | A * | 1/2000 | Aslam et al. | 399/69 |
| 6,768,882 | B2 * | 7/2004 | Omoto et al. | 399/69 |
| 7,466,934 | B2 * | 12/2008 | Chae et al. | 399/69 |
| 7,747,205 | B2 | 6/2010 | Fujii | |
| 8,145,086 | B2 | 3/2012 | Chiyoda et al. | |
| 8,265,505 | B2 * | 9/2012 | Mills et al. | 399/69 |
| 8,306,446 | B2 | 11/2012 | Ito et al. | |
| 2003/0230561 | A1 * | 12/2003 | Kagawa et al. | 219/216 |
| 2004/0033084 | A1 * | 2/2004 | Akizuki et al. | 399/69 |
| 2007/0147912 | A1 | 6/2007 | Fujii | |
| 2010/0135686 | A1 * | 6/2010 | Li et al. | 399/69 |
| 2011/0006051 | A1 | 1/2011 | Chiyoda | |
| 2011/0280634 | A1 * | 11/2011 | Yoshimura et al. | 399/323 |
| 2012/0051806 | A1 * | 3/2012 | Takahashi | 399/323 |
| 2013/0051826 | A1 * | 2/2013 | Chiyoda | 399/45 |

FOREIGN PATENT DOCUMENTS

| | | | |
|---|---|---|---|
| JP | 2005258035 | * | 11/2004 |
| JP | 2007-178732 | A | 7/2007 |
| JP | 2011-33848 | A | 2/2011 |
| JP | 2011-145425 | A | 7/2011 |

OTHER PUBLICATIONS

Machine English Translation Echigo Nov. 3, 2004 JP2005-258035.*

* cited by examiner

*Primary Examiner* — G. M. Hyder
*Assistant Examiner* — Travis Harper
(74) *Attorney, Agent, or Firm* — Fitzpatrick, Cella, Harper & Scinto

(57) ABSTRACT

A toner image heater includes a heating roller; an external heater for heating the heating roller; a heater for heating the external heater; a detector for detecting a temperature of the external heater; a controller for maintaining the external heater at a target temperature; and an air blower for blowing air toward the heating roller when a predetermined kind of the recording material is separated from the heating roller, wherein the controller controls the target temperature in accordance with information corresponding to a temperature of the air blown from the air blower.

13 Claims, 7 Drawing Sheets

IMAGE HEATING APPARATUS

FIELD OF THE INVENTION AND RELATED ART

The present invention relates to an image heating apparatus for heating a toner image on a recording material. The image heating apparatus is usable with an image forming apparatus such as a copying machine, a printer, a facsimile machine and a complex machine having a plurality of functions of them.

A known electrophotographic image forming apparatus comprises a fixing device (image heating apparatus) for fixing a toner image on a recording material formed on the recording material.

There is a demand that such an image forming apparatus can form images or various recording materials, particularly on a thin paper sheet.

When an image forming operation is carried out on such a thin sheet, the thin sheet readily winds around a fixing roller (heating rotatable member) of the fixing device, and if it occurs, the thin sheet is not separated properly from the fixing roller, with the result of sheet jam.

In the fixing device disclosed in Japanese Laid-open Patent Application 2007-178732 and Japanese Laid-open Patent Application 2011-145425, an air blowing device is used to blow the air to the fixing roller to properly separate the thin sheet from the fixing roller.

However, when the air is blown to the fixing roller with air blowing device in an attempt to improve the separation property of the thin paper, the following problems arise.

In the situation that the ambient temperature inside the image forming apparatus is low, immediately after the actuation of the main voltage source of the image forming apparatus, for example, the low temperature air is blown from the air blowing device, and therefore, a unintentional temperature drop of the fixing roller occurs. As a result, in the subsequent fixing process, the heat supply to the recording material is insufficient with the result of improper fixing.

The inventor thought of compensating the temperature drop of the fixing roller due to the air blowing using an external heating roller (external heating member) provided in the fixing device disclosed in Japanese Laid-open Patent Application 2011-33848.

However, in the situation that the ambient temperature inside the image forming apparatus is high when the operation time of the fixing device is long, the temperature compensation of the external heating roller similarly to the situation in which the ambient temperature is low, overheating may occur. This is because the temperature of the air is high when the ambient temperature in the image forming apparatus is high.

SUMMARY OF THE INVENTION

Accordingly, it is a principal object of the present invention to provide an image heating apparatus with which the separation property of the recording material from the heating rotatable member is improved, and the temperature compensation for the heating rotatable member by an external heating member is proper.

According to an aspect of the present invention, there is provided an image heating apparatus comprising a heating rotatable member for heating a toner image on a recording material in a nip; a nip forming member cooperative with said heating rotatable member to form the nip; an external heating member for contacting with an outer surface of said heating rotatable member to heat said heating rotatable member; a heater for heating said external heating member; a detector for detecting a temperature of said external heating member; a controller for controlling said heater in accordance with an output of said detector so that said external heating member maintains a target temperature; and an air blowing device for blowing air toward said heating rotatable member when a predetermined kind of the recording material is separated from said heating rotatable member, wherein said controller controls the target temperature of said external heating member in accordance with information corresponding to a temperature of the air blown from said air blowing device.

These and other objects, features, and advantages of the present invention will become more apparent upon consideration of the following description of the embodiments.

DESCRIPTION OF THE PREFERRED EMBODIMENTS

Referring to the accompanying drawing, the embodiments of the present invention will be described. However, the present invention is not limited to the specific embodiments The image heating apparatus of the present invention is not limited to the one provided in an image forming apparatus, but may be an independent image heating apparatus usable with an image forming apparatus.

The image forming apparatus is not limited to the structure which will be described hereinafter, but may be a monochromatic image forming apparatus, another image formation system. The image forming apparatus is used for various purposes such a printer, a copying machine, a facsimile machine and a complex machine having a plurality of functions of them.

<Image Forming Apparatus>

Figure 1:
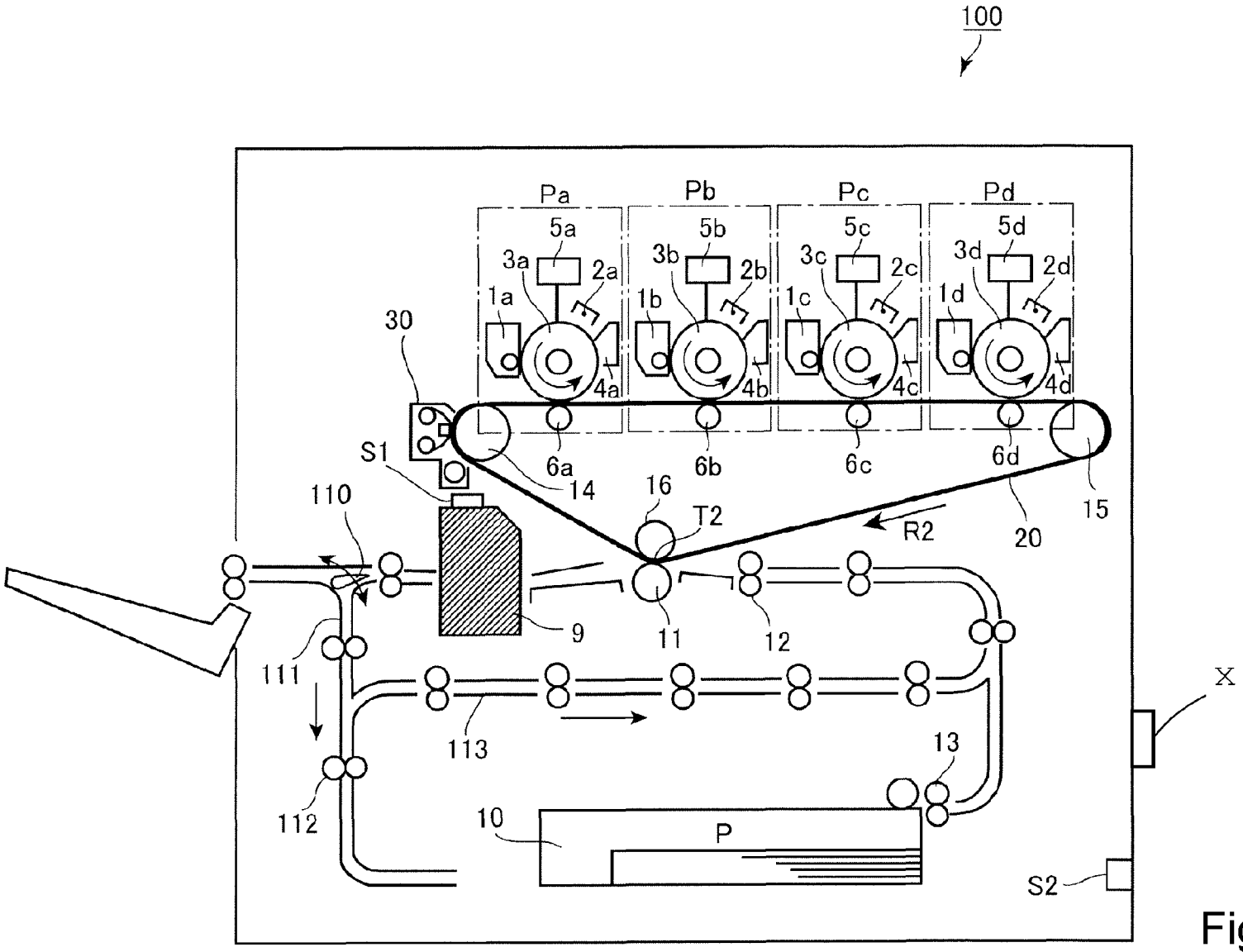
FIG. 1 is an illustration of an image forming apparatus.

FIG. 1 is an illustration of an image forming apparatus. As shown in FIG. 1, an image forming apparatus 100 of this embodiment is a tandem type, intermediary transfer type full color printer including yellow, magenta, cyan and black image forming stations Pa, Pb, Pc and Pd arranged along an intermediary transfer belt 20.

In the image forming station Pa, a yellow toner image is formed on a photosensitive drum 3*a* and is transferred onto the intermediary transfer belt 20. To image forming station Pb the magenta toner image is formed on a photosensitive drum 3*b* and is transferred onto the intermediary transfer belt 20. In the image forming stations Pc, Pd, a cyan toner image and a black toner image are formed on photosensitive drums 3*c*, 3*d*, respectively, and are transferred onto the intermediary transfer belt 20.

The recording material P is picked up from a recording material cassette 10 and is singled out by a separation roller 13, and then is once stopped by registration rollers 12. The recording material P is fed to a secondary transfer portion T2 by the registration rollers 12 and receives the toner images from the intermediary transfer belt 20. The recording material P now having the four color toner images is fed to a fixing device 9 and is subjected to heat pressing by the fixing device 9 so that the toner image is fixed on the surface thereof, and finally is stacked on an external discharging tray.

The foregoing deals with the case of one-side printing. In the case of both side printing, the recording material P having the fixed image is guided by a flapper 110 toward a reversion path 111. The recording material P is switched back by a reversing roller 112, and is directed to a both-side-printing path 113 with the facing orientation reversed, and is stopped by the registration rollers 12. In the secondary transfer portion T2, the recording material receives the toner image on the back side, and the toner image is fixed on the back side, and finally is stacked on the external discharging tray.

The image forming stations Pa, Pb, Pc, Pd have substantially the same structures except that the colors of the toner used in developing devices 1*a*, 1*b*, 1*c*, 1*d* are, but yellow, magenta, cyan and black. In the following, the description will be made as to the image forming station Pa, and for the image forming stations Pb, Pc, Pd, the description of the image forming station Pa applies by reading the subscript "a" as b, c or d.

The image forming station Pa comprises a corona charger 2*a*, an exposure device 5*a*, a developing device 1*a*, a transfer roller 6*a* and a drum cleaning device 4*a* disposed around the photosensitive drum 3*a*. The corona charger 2*a* charges the surface of the photosensitive drum 3*a* to a dark portion potential VD uniformly by applying charged particles produced by corona discharging. The exposure device 5*a* deflect a laser beam to scan the photosensitive drum 3*a* so as to decrease the dark portion potential VD to a light portion potential VL, thus writing an electrostatic image thereon. The developing device 1*a* develops the electrostatic image into a toner image on the photosensitive drum 3*a*. The transfer roller 6*a* is supplied with a DC voltage to transfer the toner image from the photosensitive drum 3*a* onto the intermediary transfer belt 20. The drum cleaning device 4*a* collects untransferred toner remaining on the photosensitive drum 3*a* without being transferred to the intermediary transfer belt 20.

The intermediary transfer belt 20 is extended around a driving roller 15, a tension roller 14 and an opposing roller 16 and is driven by driving roller 15 to rotate in the direction of an arrow R2. A secondary transfer roller 11 constitutes the secondary transfer portion T2 where it is contacted to the intermediary transfer belt 20 supported by the opposing roller 16 at an inner side surface. In the process of passing the recording material P through the secondary transfer portion with the recording material P on the negatively charged toner image on the intermediary transfer belt 20, the secondary transfer roller 11 is supplied with a positive voltage, by which the toner image is shifted from the intermediary transfer belt 20 to the recording material P. A belt cleaning device 30 collects untransferred toner remaining on the intermediary transfer belt 20 without being transferred to the recording material P.

<Fixing Device>

Figure 2:
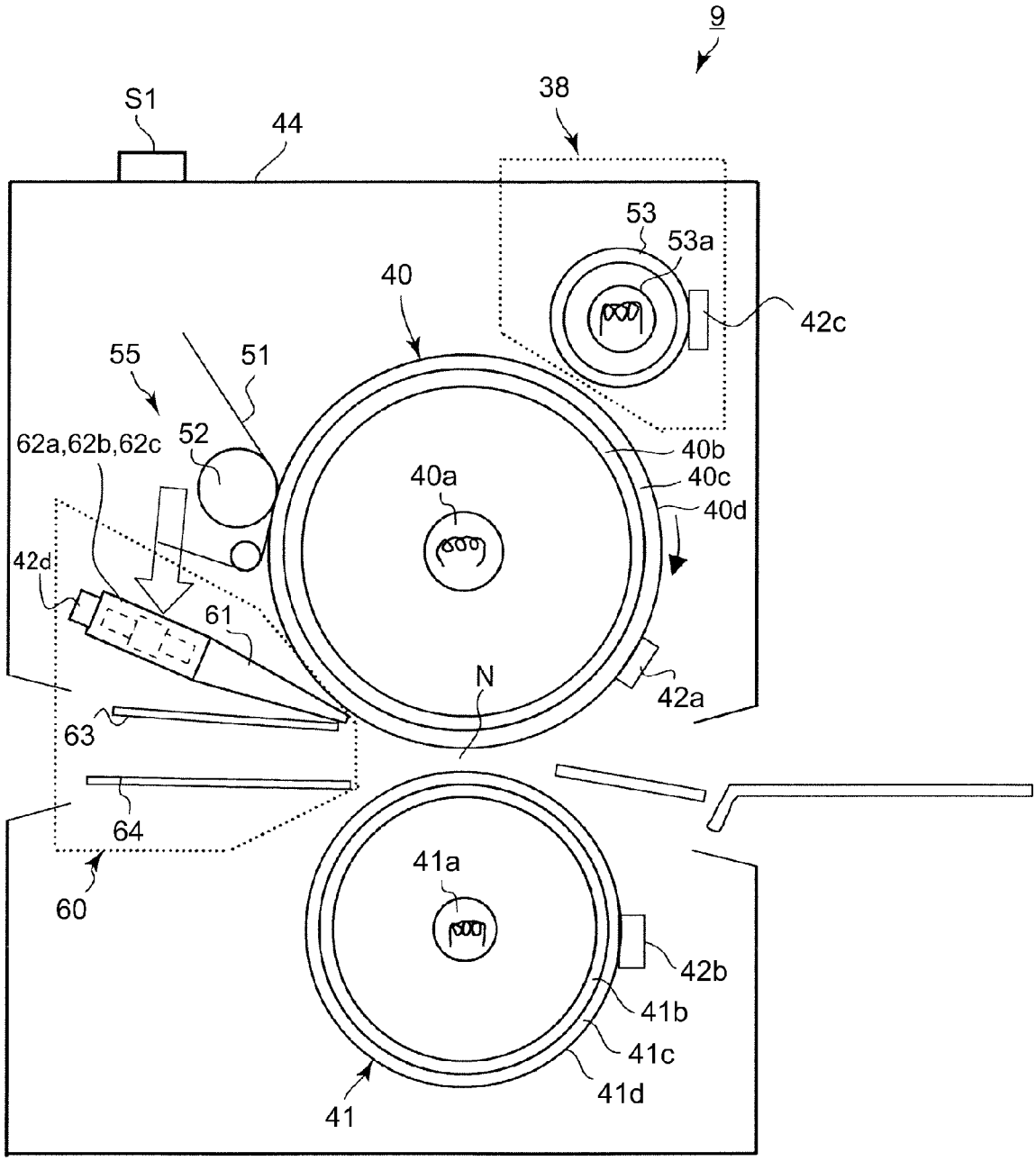
FIG. 2 is an illustration of a fixing device in a stand-by state of image formation.
Figure 3:
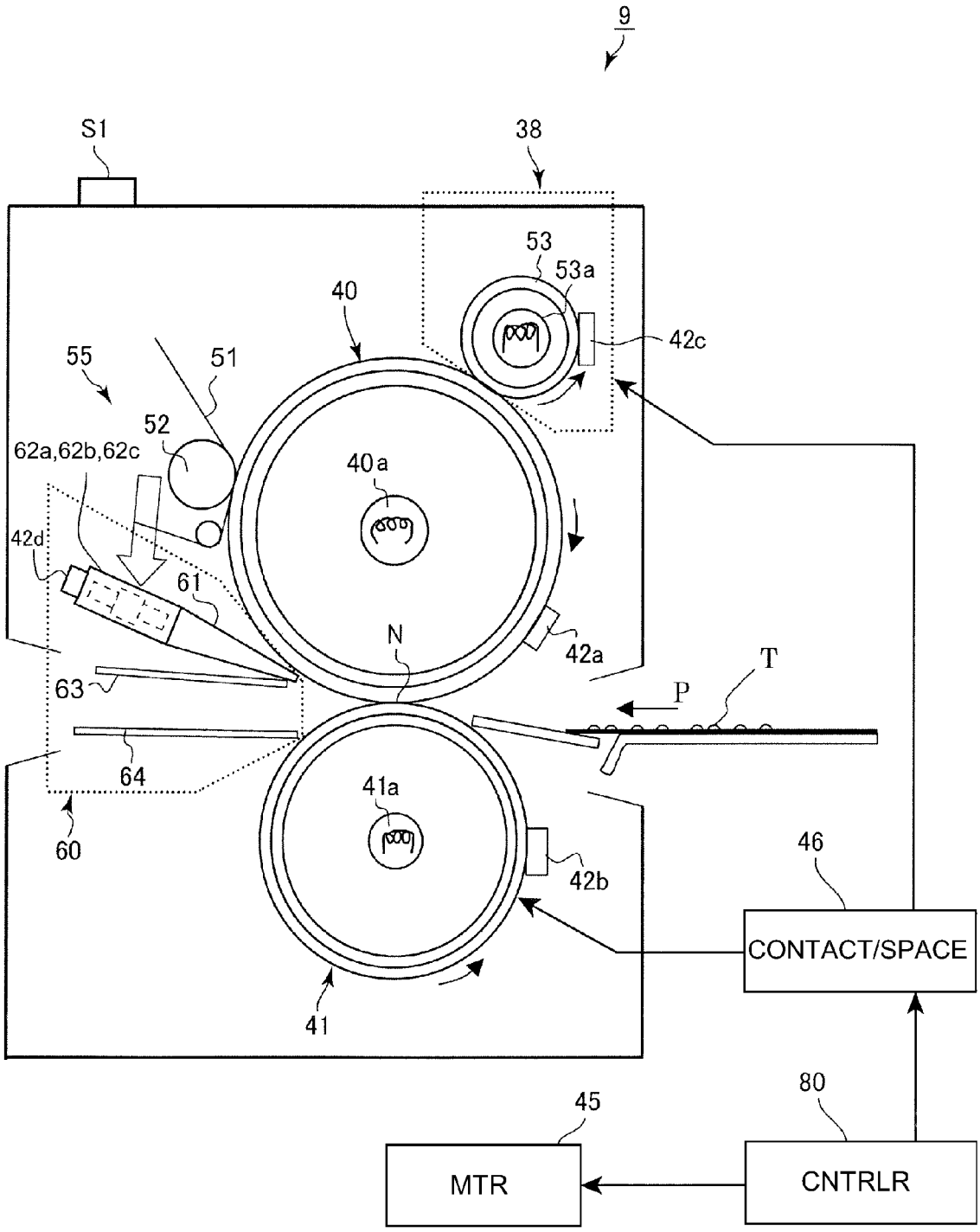
FIG. 3 is an illustration of the fixing device in image forming operation.
Figure 4:
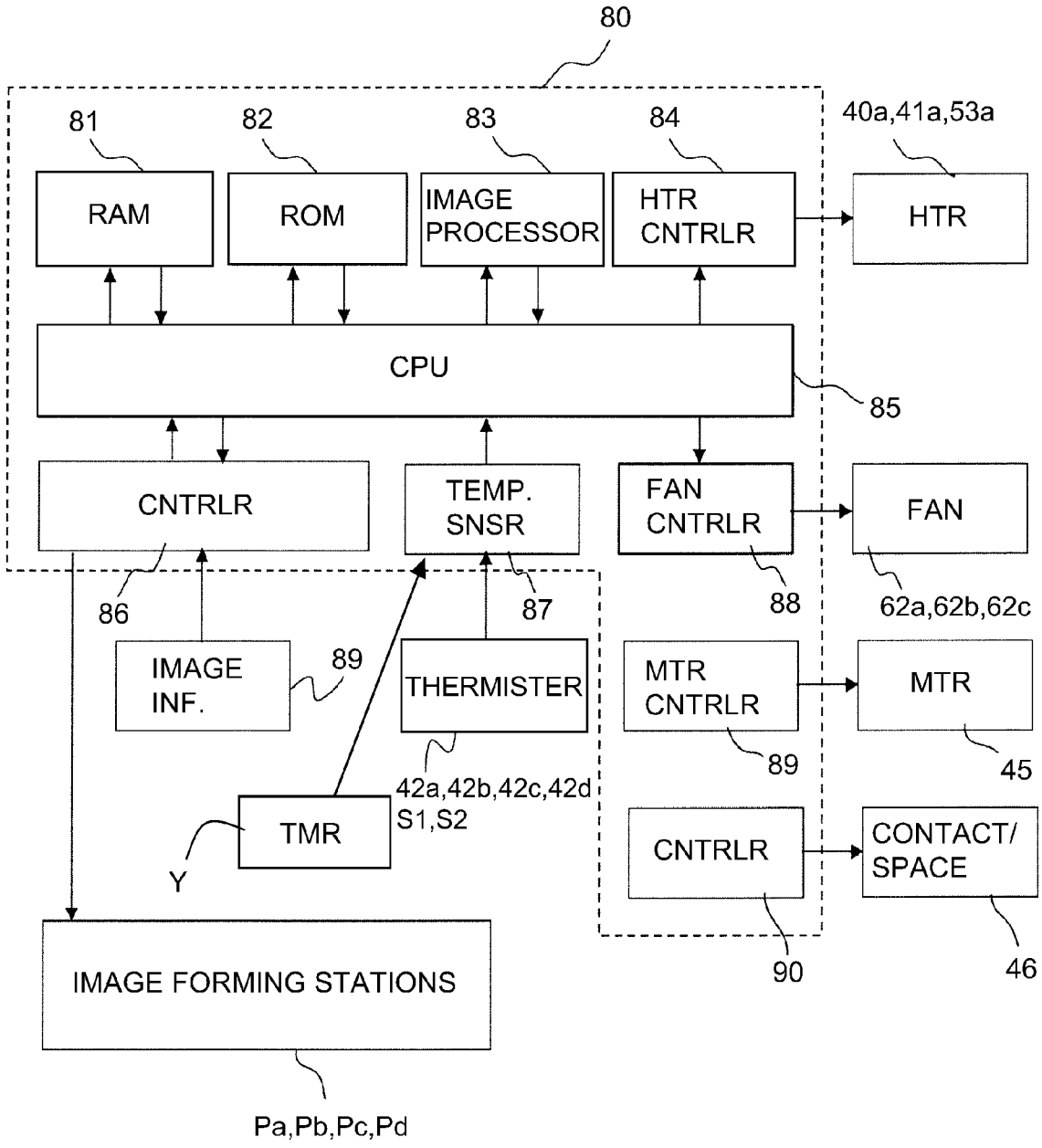
FIG. 4 is a block diagram of a control system of the image forming apparatus.

FIG. 2 is an illustration of a fixing device in a stand-by state of image formation. FIG. 3 is an illustration of the fixing device in image forming operation. FIG. 4 is a block diagram of a control system of the image forming apparatus. In the fixing device 9, the heating and the pressing are effected in a heating nip formed between a fixing roller and a pressing roller which will be described hereinafter, so as to fix the toner image on the recording material.

As shown in FIG. 2, the fixing roller 40 functions as a heating rotatable member (fixing member) is contacted by an unfixed toner image (image surface) formed on the recording material. The pressing roller 41 functions as a nip forming member (pressing member) forms a recording material heating nip (nip) N by contacting to the fixing roller 40. The fixing roller 40 is heated in a predetermined temperature.

The fixing roller 40 and an external heating roller 53 functioning as an external heating member are made of metal rollers and are heated by lamp heaters 40*a*, 53*a* provided along center axes, respectively. The lamp heaters 40*a*, 53*a* are supplied with respective electric power controlled on the basis of temperatures detected by thermisters 42*a*, 42*c* (an example of a temperature detecting element) contacted to the surfaces of the fixing roller 40 and the external heating roller 53. The heating method for the fixing roller 40 may use a resistance heating, an electromagnetic induction heating and is not limited to the above-described lamp heater. In addition, the heating rotatable member, the nip forming member and the external heating member may be in the form of belt members instead of the above-described roller members.

In the stand-by state in which the recording material is not in the heating nip N, the fixing device 9 spaces the pressing roller 41 from the fixing roller 40 and spaces the external heating roller 53 from the fixing roller 40.

As shown in FIG. 3, when the recording material reaches the heating nip N, the fixing device 9 press-contacts the pressing roller 41 to the fixing roller 40 to establish the heating nip N for the recording material. Simultaneously, it contacts the external heating roller 53 to the fixing roller 40 to heat the surface of the fixing roller 40.

As shown in FIG. 4, a controller 80 functioning as a controller (control means) executes an image formation job while controlling each unit of the image forming apparatus 100. The motor 45 rotates the fixing roller 40 shown in FIG. 3 in the clockwise direction, and simultaneously rotates the pressing roller 41 in the counterclockwise direction. The external heating roller 53 is rotated by the fixing roller 40. The recording material P having the toner image T formed by the secondary transfer portion T2 shown in FIG. 1 is nipped and fed by the fixing roller 40 and the pressing roller 41 shown in FIG. 3. The melted toner particles by the heating and the pressing are fixed in the tissue of the surface of the recording material, by which the toner image is fixed on the surface.

As shown in FIG. 2, the fixing roller 40 contains a lamp heater 40*a* functioning as a heating device (heating means) and has an outer diameter of 80 mm. The fixing roller 40 comprises a hollow cylindrical base core metal 40*b* of aluminum, steel or the like, and an outer elastic layer 40*c* of silicone rubber thereon. On the elastic layer 40*c*, there is provided a parting layer 40*d* in the form of a tube of a fluorinated resin material such as PFA (tetrafluoroethylene-perfluoroalkylvinylether copolymer resin material), PTFE (polytetrafluoroethylene) or the like.

A surface temperature of the fixing roller 40 is detected by a thermister (temperature detecting element) functioning as a detector (detecting means), and the detected surface temperature is supplied to a temperature detecting portion 87 of the controller 80 shown in FIG. 4. A heater controller 84 ON/OFF-controls the lamp heater 40*a* so as to keep the surface temperature of the fixing roller 40 at a predetermined target temperature.

The target temperature of the surface temperature of the fixing roller 40 is in the range of 150-200 degree C. for various kinds (basis weights) recording materials.

TABLE 1

| Basis weight (g/m^3) | Fixing roller | External heating roller | Blowing |
|---|---|---|---|
| ~79 | 135° C. | 180° C. | ON |
| 80~128 | 150° C. | 190° C. | ON |
| 129~150 | 170° C. | 200° C. | ON |
| 151~209 | 170° C. | 200° C. | OFF |
| 210~256 | 185° C. | 210° C. | OFF |
| 257~300 | 200° C. | 220° C. | OFF |

As shown in Table 1, the output images are fixed with a throughput of 60 sheets per minute, irrespective of the basis weight of the recording material, in a state that the surface temperature of the fixing roller 40 is maintained within the predetermined range including the target temperature at the center thereof.

The pressing roller 41 contains a lamp heater 41*a* as a heating element and has an outer diameter of 60 mm. The pressing roller 41 comprises a core metal 41*b* (hollow cylindrical base) of aluminum, steel or the like, and an elastic layer 41*c* of silicone rubber thereon. The outer surface of the elastic layer 41*c* is coated with a parting layer 41*d* of tube of fluorinated resin material such as PFA, PTFE or the like.

The surface temperature of the pressing roller 41 is detected by a thermister (temperature detecting element) 42*b*, and the detected surface temperature is fed to the temperature detecting portion 87 of the controller 80 shown in FIG. 4. The heater controller 84 ON/OFF-controls the lamp heater 41*a* so as to keep the surface temperature of the pressing roller 41 at a target temperature.

The pressing roller 41 is urged upwardly by an urging mechanism provided at each end portion with respect to a rotational axis direction, by which it is press-contacted to the fixing roller 40 at a total pressure of approx. 784 N (approx. 80 kgf). The pressing roller 41 can be contacted and spaced relative to the outer surface of the fixing roller 40.

The pressing roller 41 is supported by a pivotable table which is pivotable about a rotational shaft disposed in an outlet side of the heating nip N. The pivotable table is pivoted by a spacing mechanism 46 using a cam shown in FIG. 4 to raise and lower the pressing roller 41. The spacing mechanism 46 controls the press-contacting/spacing relative to the fixing roller 40.

Recently, the image formation on various recording materials such as a thick sheet, a thin sheet, a textile or a resin material sheet, in addition to plain paper sheet are desired. It would be considered to make the diameter of the fixing roller larger and to enhance the heating power, in order to form images on the thin sheets having a small thermal capacity and thick sheets having a large thermal capacity and to accomplish a high throughput in the case of the thick sheets. However, in the case of the thin sheet, it is more likely that the recording material is stuck on the fixing roller due to the viscosity resulting from the melting of the unfixed toner image and, if it occurs the recording material is not separated from the fixing roller at the outlet of the heating nip.

In the image forming apparatus 100 of this example, the air is blown to the outlet side of the heating nip N so as to separate forcefully the recording material from the fixing roller 40. In order to solve this problem, the compressed air is blown to the leading edge of the recording material to peel the recording material off the fixing roller 40.

It is not preferable that the air is blown always, from the standpoint of the energy conservation, and therefore, it is preferable that the air is not blown as for the recording materials having a large basis weight, such as thick sheets.

In addition, in this example, is air flow rate blown to the fixing roller 40 is changeable.

<Blowing Device>

Figure 5:
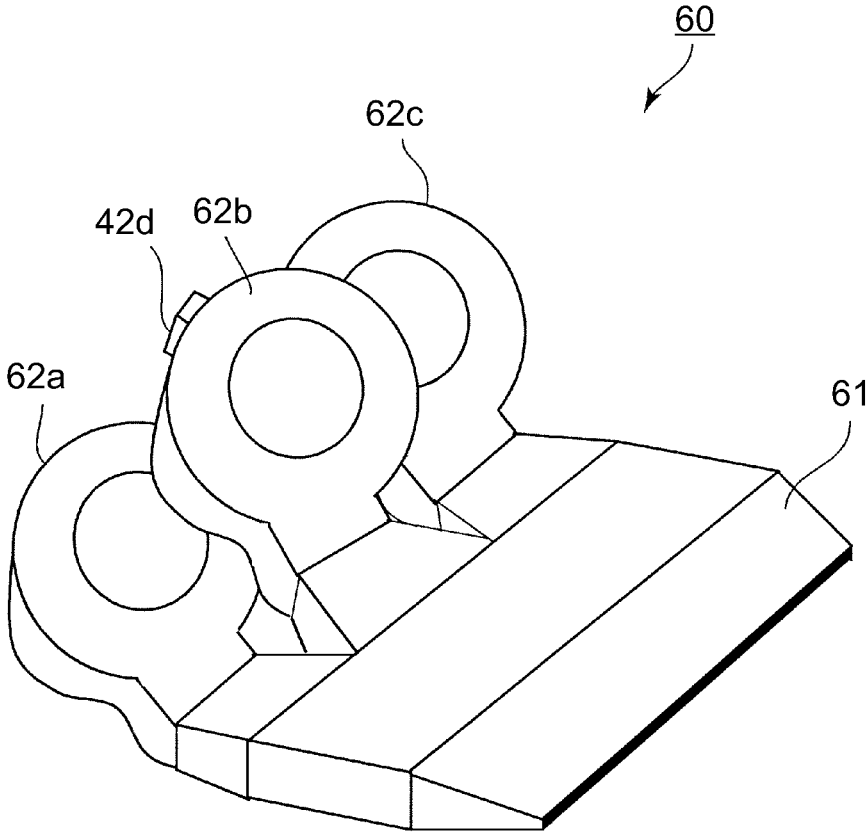
FIG. 5 is a perspective view of an outer appearance of a blowing device.

FIG. 5 is a perspective view of an outer appearance of a blowing device. As shown in FIG. 3, an air separating unit 60 functioning as an air blower (air blowing means) blows the air to the fixing roller 40 at the outlet side of the heating nip N at a variable flow rate.

The air separating unit 60 is disposed in the downstream side of the heating nip N of the fixing device 9 with respect to the sheet feeding direction. The air separating unit 60 is provided with guiding plates 63, 64 for guiding a discharging recording material P to the downstream side of the heating nip N with respect to the feeding direction. The air separating unit 60 comprises a flow path forming member 61 having an opening at its free end portion which is adjacent to the surface of the fixing roller 40, the air delivered from the fan means 62 is blown toward the heating nip N through the flow path forming member 61.

As shown in FIG. 5, the air separating unit 60 blows the air to the fixing roller 40 and the recording material P at the position downstream of the heating nip N with respect to the feeding direction to assist the separation of the recording material P from the fixing roller 40. The fan means 62 includes three fans 62*a*, 62*b*, 62*c*, and the air delivered therefrom is merged into the common flow path forming member (nozzle) 61 and is capable of being blown with a substantially uniform flow rate distribution within a passing range of the recording material in an axial direction of the fixing roller 40.

As shown in FIG. 4, a fan controller 88 can set the rotational speeds of the fans 62*a*, 62*b*, 62*c* within the range of 100 rpm-3400 rpm. When the fans 62*a*, 62*b*, 62*c* are operated at the maximum speed, a flow rate of approx. 3 m^3/min is provided.

The fan controller 88 can change the flow rate at the outlet of the flow path forming member 61 in the range of approx. 0.3 m^3/min to approx. 3.0 m^3/min by changing the number of operating fans and the rotational frequency of each of them.

By blowing the air to the leading edge of the recording material P on which the toner image is fixed in the heating nip N, the recording material P stuck on the fixing roller 40 is properly separated or peeled off. In the fixing device 9 of this example, the air pressure is changed depending on the basis weight of the recording material, the sticking and/or wrapping of the recording material on the fixing roller 40 can be stably avoided.

<External Heating Roller>

As shown in FIG. 2, the lamp heater 40*a* functioning as the heating device (heating means) heats the entirety of the fixing roller 40 so that a surface temperature of the position of the fixing roller 40 away from a region where the air is blown is kept at the target temperature.

On the other hand, the external heating roller 53 functioning as the external heating member is provided between the air blowing position and the heating nip N with respect to the rotational moving direction of the fixing roller 40 to keep the surface of the fixing roller 40 at the target temperature.

When the air separation and fixing structure is used in the fixing device having a plurality of target temperatures corresponding to various types of the recording materials, the surface temperature of the fixing roller may unintentionally fall due to the air blowing to the fixing roller. The elastic layer 40*c* of the fixing roller 40 is a rubber layer which has low thermo-conductivity, and therefore, a thermal response from the lamp heater 40*a* may not be quick enough to compensate for the heat quantity deprived by the recording material P in the heating nip N between the fixing roller 40 and the pressing roller 41.

In the fixing device 9 of this embodiment, the external heating roller 53 is provided to solve this problem. The external heating roller 53 is provided to keep the surface temperature of the fixing roller 40 constant.

The external heating roller 53 includes a lamp heater 53*a* as a heating device (heating means) therein and is capable of contacting and spacing relative to the outer surface of the fixing roller 40 by a spacing mechanism 46 functioning as a moving mechanism (moving means). During image forming operation, the length of the contact between the external heating roller 53 and the fixing roller 40, measured in the direction of the peripheral movement is approx. 6 mm.

The external heating roller 53 includes a hollow cylindrical metal base of aluminum, steel, stainless steel or the like having high thermal conductivity. The surface of the metal base may be coated with a resin material having a parting property. The external heating roller 53 is heated from the inside by the lamp heater 53*a* provided non-rotatably in the inside so that the surface temperature of the external heating roller 53 is higher than the target temperature of the fixing roller 40. The external heating roller 53 is supported rotatably by high heat resistive heat insulating bushes at the opposite ends.

A thermister 42*c* functioning as a detector (detecting means) is provided contacted to the outer surface of the external heating roller 53 to detection the surface temperature thereof. During the image forming operation, the temperature detecting portion 87 supplies outputted of the thermister 42*c*, and the heater controller 84 controls the electric power supply to the lamp heater 53*a* in accordance with the temperature information. By this, the surface temperature of the external heating roller 53 is controlled at the target temperature.

The target temperature of the external heating roller 53 is set so as to be higher than the target temperature of the fixing roller 40. When the target temperature of the fixing roller 40 is 160 degree C., for example, the target temperature of the external heating roller 53 is set to 200 degree C. with the 40 degree C. temperature difference. If the temperature of the external heating roller 53 is not kept higher than the temperature of the fixing roller 40, the heat is not supplied to the fixing roller 40 from the external heating roller 53 with quick response (thermal sensitivity) upon drop of the surface temperature of the fixing roller 40.

If the temperature difference is too large, the surface temperature of the fixing member 40 may exceed the set target temperature. If the external heating roller 53 heats the fixing roller 40 more than necessitated by the heat deprivation by the air blowing of the air separating mechanism 60, the temperature adjustment control of the fixing roller by the lamp heater 40*a* is disturbed.

Embodiment 1

Figure 6:
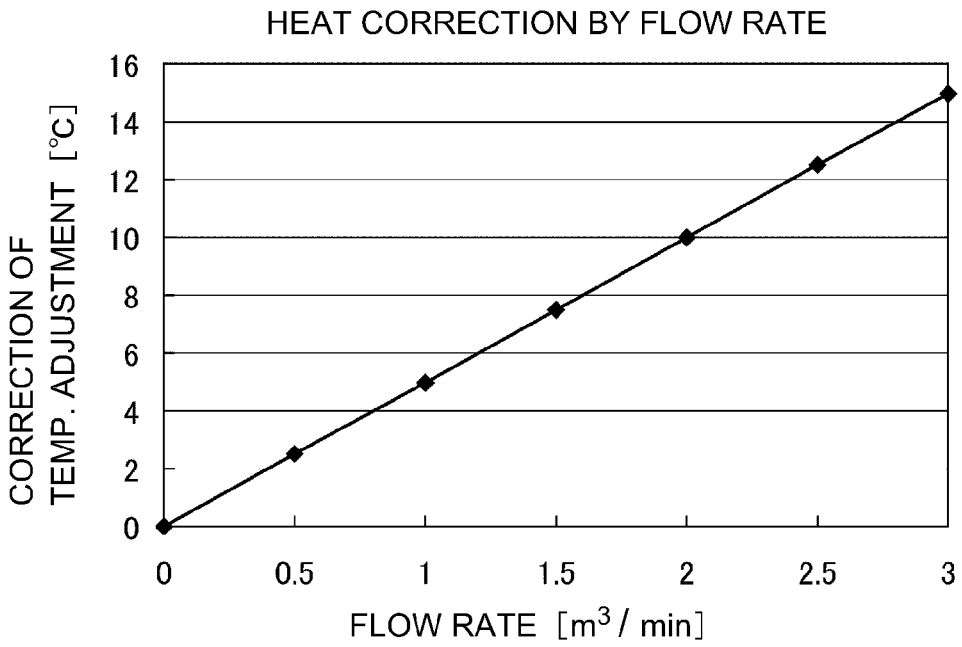
FIG. 6 is an illustration of a temperature adjustment control for external heating roller in accordance with an air flow rate.
Figure 7:
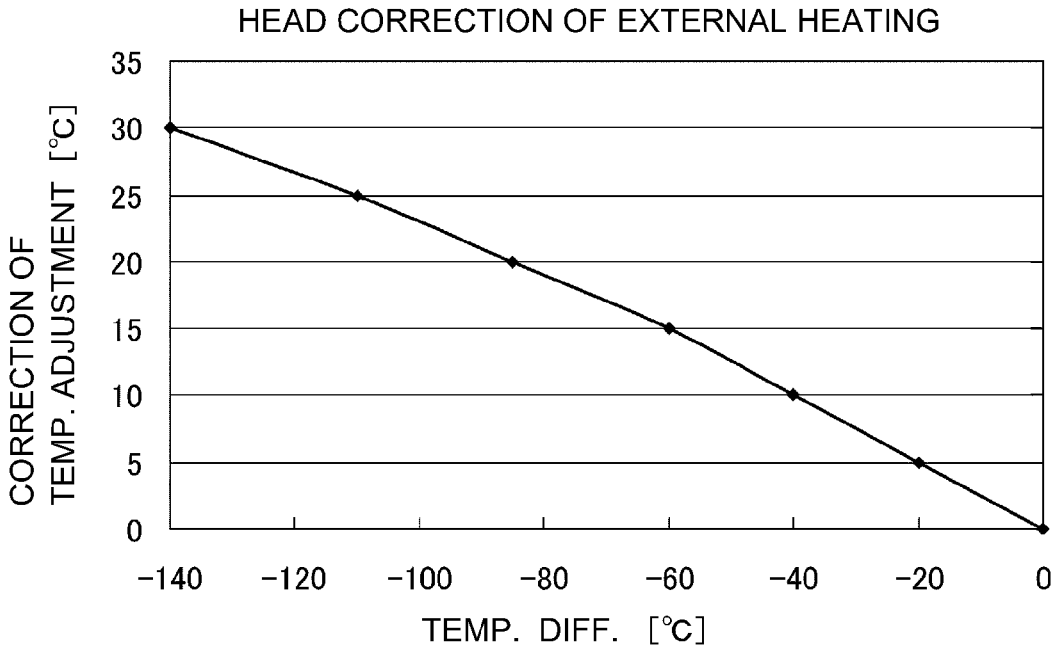
FIG. 7 is an illustration of the temperature adjustment control for the external heating roller in accordance with a temperature of the air.

FIG. 6 is an illustration of a temperature adjustment control for external heating roller in accordance with an air flow rate. FIG. 7 is an illustration of the temperature adjustment control for the external heating roller in accordance with a temperature of the air.

As shown in FIG. 4 referring to FIG. 3, the controller 86, the temperature detecting portion 87 and so on input the state of air blowing to the fixing roller 40 (the ON/OFF state, the flow rate and the air temperature). The controller 80 functioning as the controller (control means) controls a heating condition of the fixing roller 40 by the external heating roller 53 in accordance with the information inputted to the controller 86, the temperature detecting portion 87 and so on so that the temperature of the region of the fixing roller 40 on which the blown air impinges approaches to the target temperature.

The fans 62*a*, 62*b*, 62*c* blows to the fixing roller the air, the temperature of which changes. To the controller 80, the information (temperature information) corresponding to the temperature of the air blown to the fixing roller 40 is inputted. The controller 80 adjusts the heating condition of the fixing roller 40 by the external heating roller 53 on the basis of the temperature information wherein the heating quantity to the surface of the fixing roller 40 increases with decrease of the temperature of the air blown to fixing roller 40.

Fans 62*a*, 62*b*, 62*c* are capable of blowing the air to the fixing roller with the variable setting of the flow rate. To the controller 80, the flow rate information relating to the flow rate of the air blown to the fixing roller 40 is inputted. The controller 80 adjusts the heating condition of the fixing roller 40 by the external heating roller 53 on the basis of the flow rate information so as to increase the heating quantity to the surface of the fixing roller 40 with increase of the flow rate of the air blown to the fixing roller 40.

The flow rate provided by the air separating unit 60 is variable in the range of approx. 0.3 m^3/min to approx. 3.0 m^3/min in accordance with the electric power supplied to the fans 62*a*, 62*b*, 62*c*. The drop of the surface temperature of the fixing roller 40 increases with increase of the flow rate to the fixing roller 40, and therefore, it is preferable that the heating quantity by the external heating roller 53 is increased.

A cover 44 functioning as housing covers the entirety of the fixing device. Therefore, the cover 44 constitutes a stagnation space for the air heated by the fixing roller 40. The air separating unit 60 includes an outlet nozzle opening toward the peripheral surface of the fixing roller 40, wherein the fans 62*a*, 62*b*, 62*c* sucks the air from the stagnation space and supplies it to the nozzle. The outlet of the nozzle continuously opens along the direction of the generatrix of the peripheral surface of the fixing roller 40.

The fans 62*a*, 62*b*, 62*c* takes (sucks) the high temperature air stagnating adjacent the top portion enclosed by the cover 44 of the fixing device 9 and supplies it to the flow path of the flow path forming member 61. The temperature of the air blown to the fixing roller 40 utilizing the rise of the ambient temperature of the stagnation space by the operations of the lamp heaters 40*a*, 41*a*, 53*a*, by which the temperature drop of the fixing roller 40 blown by the air is at the minimized, thus reducing the load of the lamp heater 40*a* to save the energy.

However, the temperature of the air blown to the fixing roller 40 by the fans 62*a*, 62*b*, 62*c* is the ambient temperature of the upper space in the fixing device 9, and therefore, the temperature widely ranges from approx. 30 degree C. to approx. 160 degree C., depending on the operation duration of the fixing device 9 (the elapsed time from actuation of the main voltage source). Immediately after the actuation of the main voltage source of the image forming apparatus 100, that is, immediately after starting of the fixing device, the temperatures of the metal plates and the members around the fixing roller 40 are close to the normal temperature, and therefore, the temperature of the air is approx. 30 degree C. Thereafter, with the execution of the image formation jobs, the member and the ambience around the fixing device 9 are warmed, and the temperature of the air gradually rises even to the extent of 160 degree C. if continuous sheet processing image formation jobs are continued without the rest.

When the temperature of the blowing air of the air separating unit 60 is low, the supplied heat quantity to the fixing roller 40 tends to be insufficient. As a result, the temperature drop of the fixing roller 40 occurs. If the temperature of the blowing air by the fans 62*a*, 62*b*, 62*c* is lower, that is, if the difference between the surface temperature (target temperature) of the fixing roller 40 and the temperature of the blowing air, the surface layer of the fixing roller 40 passing the blowing position is cooled more. Thus, there is a possibility that the temperature of the fixing roller 40 becomes unstable by blowing the air to the fixing roller 40.

In addition, when the temperature of the blowing air of the air separating unit 60 is high, the supplied heat quantity to the fixing roller 40 from the external heating roller 53 tends to be excessive. As a result, is surface temperature of the fixing roller 40 may exceed the target temperature (160 degree C.). In such a case, the glossiness of the output image changes, and the apparent density of the image may change. The quality of the output image may differ between the former period (the temperature of the blowing air is relatively lower) and the later period (the temperature of the blowing air is relatively high) of the image formation job.

In this example, the temperature compensating function of the external heating roller 53 for the fixing roller 40 is controlled in accordance with the temperature information of the blowing air of the air separating unit 60 to the fixing roller 40. More specifically, the target temperature of the external heating roller 53 is controlled in response to the information corresponding to the temperature of the blowing air to the fixing roller 40 from the air separating unit 60, as follows.

More in detail, when the temperature of the blowing air is not lower than a predetermined temperature, the controller 80 sets the target temperature of the external heating roller 53 at a first target temperature. On the other hand, when the temperature of the blowing air is lower than the predetermined temperature, the controller 80 sets the target temperature of the external heating roller 53 at the second target temperature which is lower than the first target temperature.

The information corresponding to the temperature of the blowing air to the fixing roller 40 from the air separating unit 60 may be the information for indirectly determining (deducing) the temperature of the blowing air, as well as the information of the temperature of the blowing air directly detected, as will be described hereinafter. An obtaining method for the air temperature information may be any as long as the information corresponding to the temperature of the blowing air can be obtained properly.

In such a case, when the temperature of the blowing air is deduced to be not lower than the predetermined temperature, the controller 80 sets the target temperature of the external heating roller 53 at the first target temperature. On the other hand, when the temperature of the blowing air is deduced to be lower than the predetermined temperature, the controller 80 sets target temperature of the external heating roller 53 at the second target temperature which is lower than the first target temperature.

Furthermore, in this example, a temperature difference between a target temperature of the fixing roller 40 and a target temperature of the external heating roller 53 is set in accordance with the flow rate and the temperature of the blowing air to the fixing roller 40.

As shown in FIG. 5, a casing of the fan 62*b* is provided with a thermister 42*d* functioning as a detector (detecting means) for detecting the temperature of the blowing air to the fixing roller 40 from the air separating unit 60. Tables prepared from FIGS. 6, 7 are prepared in the ROM 82. When the target temperature of the fixing roller 40 is 160 degree C., the target temperature of the external heating roller 53 is set to 200 degree C. with the temperature difference of the 40 degree C.

As shown in FIG. 3 referring to FIG. 4, in Embodiment 1, when the target temperature of the fixing roller 40 is 160 degree C., the controller 80 sets the target temperature) of the external heating roller 53 at 200 degree C. under the condition that the air is not blown to the fixing roller 40. The controller 80 refers the table prepared from the graph of FIG. 6 with the flow rate on the X axis to determine the temperature adjustment correction value, which is added to the 200 degree C. of the flow rate of 0 m^3/min to provide the target temperature for the external heating roller 53. The target temperature of the external heating roller 53 is raised with increase of the flow rate to compensate for the heat quantity deprived by the air.

When the flow rate is 1 m^3/min, the temperature adjustment correction value of 5 degree C. is added to set the target temperature of the external heating roller 53 to 205 degree C. When the flow rate is 3 m^3/min which is the maximum, the temperature adjustment correction value of 15 degree C. is added to set the target temperature of the external heating roller 53 to 215 degree C.

As shown in FIG. 3 referring to FIG. 4, the controller 80 is given the correct air temperature on the basis of the output of the thermister 42*d*. The controller 80 refers to the graph of FIG. 7 determines an outer heating temperature adjustment difference value from the temperature difference between the target temperature of the fixing roller 40 and the air temperature, and 200 degree C. is added to the outer heating temperature adjustment difference value, thus setting the target temperature of the external heating roller 53.

When the temperature of the separation air (blowing air) is 60 degrees lower than the fixing roller temperature adjustment level of 160 degree C., that is, 100 degree C., the target temperature of the external heating roller 53 is set to 215 degree C. When the temperature of the separation air is 110 degrees lower than the fixing roller temperature adjustment level of 160 degree C., that is, 50 degree C., the target temperature of the external heating roller 53 is set to 225 degree C.

FIG. 6 is a graph of the plots of the temperature rise of the external heating roller 53 which is capable of keeping the temperature of the fixing roller 40 by rendering ON/OFF the air blowing of the fans 62*a*, 62*b*, 62*c*, at the initial stage, in the image forming apparatus 100, the graph being prepared on the basis of experiments.

In preparation of the graph of FIG. 6, the temperatures of the external heating roller capable of keeping the temperature of the fixing roller 40 at the constant level are determined for different air flow rates, when the target temperature of the fixing roller 40 is 160 degree C., and the temperature of the separation air is 120 degree C. The data of the graph is converted to a table.

As a result of the experiments, there is a proportional relation between the flow rate and the temperature correction value (temperature rise of the external heating roller), all flow rates.

FIG. 7 is a graph of the plots of the temperature rise of the external heating roller 53 which is capable of keeping the temperature of the fixing roller 40 by rendering ON/OFF the air blowing of the fans 62*a*, 62*b*, 62*c*, at the initial stage, in the image forming apparatus 100, the graph being prepared on the basis of experiments.

The temperature of the external heating roller 53 capable of keeping the constant temperature of the fixing roller 40 with the temperature difference of the separation air on the basis of the output of the thermister 42*d* was verified, for target temperature of 160 degree C. for the fixing roller 40. Simultaneously, it has been confirmed that the glossiness of the outputted image is substantially constant.

For the other target temperature other than 160 degree C., similar experiments has been carried out to determine the relation between the temperature of the separation air and the proper temperature adjustment level of the external heating roller 53, and a control table is prepared.

When overheated air exceeding the target temperature (160 degree C.) of the fixing roller 40, a temperature rise of the inside temperature of the apparatus due to the temperature rise of the fixing roller 40 and the temperature rise of the fixing device 9 are liable. As shown in FIG. 1, when the detected temperature of the thermister (ambient condition sensor) S1 mounted on the cover of the fixing device 9, the controller 80 operates an air cooling fan (unshown) to cool the fixing device 9 from the outside. By doing so, the excessive rise of the cover temperature of the fixing device 9 can be avoided.

According to the control of Embodiment 1, the above-described problem is solved only by the temperature adjustment setting of the external heating roller 53 without changing the hardware structure of the fixing device 9 shown in FIG. 2. As compared with the case of keeping the temperature by pre-heating of the air to be blown to the fixing roller 40, the structure of the fixing device 9 is simplified and is durable.

Embodiment 2

In Embodiment 1, when the air separation is executed in the fixing process to a predetermined recording material such as a thin sheet, the decrease of the surface temperature of the fixing roller 40 in the air separation is suppressed on the basis of the detected take-in air temperature. In place of directly detection the air temperature using the thermister 42*d*, the degree of the temperature drop of the surface of the fixing roller 40 may be indirectly predicted using a preset correlation between the operating duration of the image forming apparatus 100 and the air temperature rise (approx. 30 degree C.-approx. 160 degree C.).

In this example, as shown in FIG. 4, the elapsed time (operation time) from the start of the operation of the fixing device 9 after the actuation of the main voltage source (main switch X of FIG. 1) of the image forming apparatus 100 is measured by a measuring device the measuring means) in the form of a timer Y (FIG. 4). In accordance with the measured elapsed time, the controller 80 controls the target temperature of the external heating roller 53.

When the operating duration is less than a predetermined duration, the ambient temperature in the image forming apparatus 100 (inside temperature) is low, that is, the blowing air temperature of the air separating unit 60 is low, and therefore, the target temperature of the external heating roller 53 is set to be relatively high. On the other hand, when the operating duration exceeds the predetermined duration, the ambient temperature in the image forming apparatus 100 is relatively high. Thus, the temperature of the blowing air of the air separating unit 60 is also high, and therefore, the target temperature of the external heating roller 53 is made lower than that when it is less than the predetermined duration.

The start of the fixing device is the start of the electric power supply to the heating mechanism (heaters 40*a*, 41*a*, 53*a* in this example) of the fixing device 9 by the actuation of the main voltage source of the image forming apparatus 100. In the fixing device of this example, when it waits for image formation instructions by the user, the electric power supply to the heating mechanism (heaters 40*a*, 41*a*, 53*a* in this example) is carried out, and therefore, the inside temperature tends to rise with the operating duration. However, as described hereinbefore, the excessive inside temperature rise is avoided by operating the heat removing fan (unshown) at the predetermined timing in this example. As a result, even if the operating duration of the fixing device 9 is long, the inside temperature does not exceed an upper limit temperature (approx. 160 degree C.).

In addition, using the result of the temperature detection of the ambient condition sensor S2 (FIG. 1) in the image forming apparatus 100, the blowing air temperature (temperature rise process) to the fixing roller 40 may be deduced. The blowing air temperature (temperature rise process) may be deduced using at least one of an ambient temperature, a printing operation mode and user setting information.

The controller 80 sets the target temperature the external heating roller 53 on the basis of the deduced blowing air temperature of the air separating unit 60.

Embodiment 3

As a result of the verification experiments in Embodiment 1, the outside ambient air temperature also influences the temperature of the air blown to the fixing roller 40 from the fans 62*a*, 62*b*, 62*c*. Even immediately after the starting of the image forming apparatus 100, the air temperature is not lower than the outside temperature, and the time required for the air temperature to reach the maximum temperature is shorter when the outside temperature is higher.

In view of this, in Embodiment 3, as shown in FIG. 1, the ambient condition sensor S2 monitors the temperature and humidity of the ambient air at a position away from the fixing device 9. The controller 80 deduces change of the blowing air temperature to the fixing roller 40 on the basis of the detected temperature of the ambient air by the ambient condition sensor S2 and a cumulated value of the image forming operations, and the control using the tables of Embodiment 1 is carried out.

Embodiment 4

Figure 8:
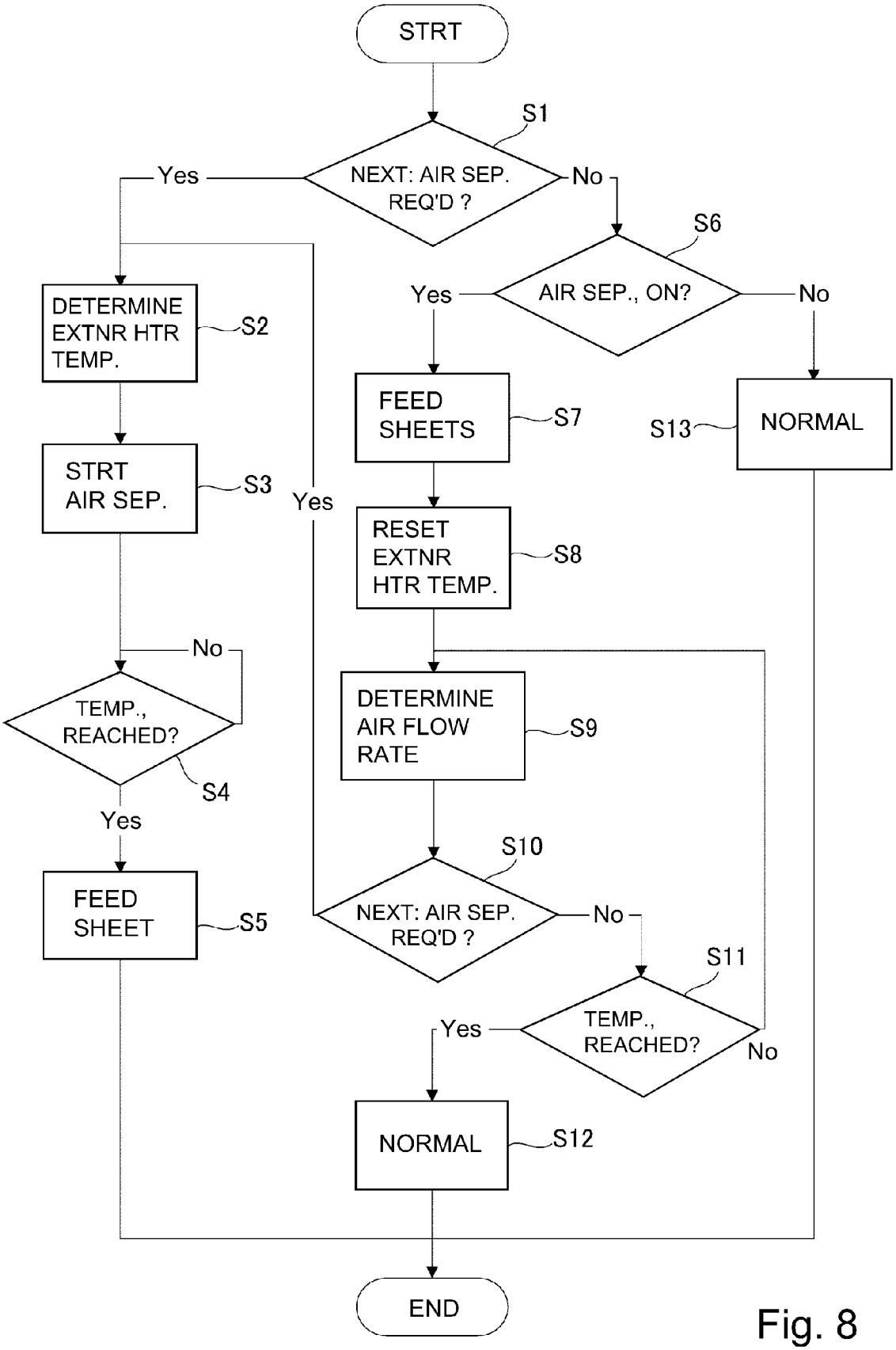
FIG. 8 is a flow chart of the temperature adjustment control for the external heating roller according to embodiment 4.

FIG. 8 is a flow chart of the temperature adjustment control for the external heating roller according to embodiment 4.

As shown in FIG. 4 referring to FIG. 3, when the recording material changes from the one not requiring the air blowing to the one requiring the air blowing, during the continuous sheet processing, the controller 80 interrupts the continuous sheet feeding. The fans 62*a*, 62*b*, 62*c* start the air blowing with a predetermined air flow rate, and the controller 80 adjusts the heating condition of the fixing roller 40 of the external heating roller 53 so that the heating quantity is increased in accordance with the predetermined flow rate. The controller 80 resumes the continuous sheet processing upon the detected temperature of the thermister 42*a* which is an example of the surface temperature of the away position reaching a target temperature.

Even when the recording material changes from the one requiring the air blowing to the one not requiring it, the controller 80 continues the continuous sheet processing. But the controller 80 switches the heating condition for the execution of the air blowing to the one for not executing the air blowing. The fans 62*a*, 62*b*, 62*c* gradually reduces the flow rate while continuing the air blowing to the recording material not requiring the air blowing.

As shown in FIG. 8 referring to FIG. 4, when the image information of the image formation job is fed sequentially to the CPU85 through the controller 86, the CPU85 receives also the information indicative of the kind of recording material simultaneously with the image pattern. The controller 80 feeds the adjustment temperature to the heater controller 84 on the basis of the information of the kind of recording material.

The controller 80 discriminates, during the execution of the image forming job, whether or not the kind of the recording material requires the air separation (S1). The controller 80 determines ON/OFF of the air separation using the media table and instructs the fan controller 88 whether to render ON/OFF. The controller 80 carries out the air separating operation as to the recording material having a Gurley stiffness not more than 0.6 mN with respect to the advancing direction (MD direction) of the recording material.

When the controller 80 discriminates that the next recording material requires the air separation (Yes in step S1), it determines the target temperature for the external heating portion roller 53 from the tables prepared from the graphs of FIGS. 6, 7 and the detected temperature of the separation air (temperature difference). At this time, the air wind amount is set to maximum 3 m^3/min to provide maximum separating effect. As has been described with Embodiment 1, when the temperature difference of the fixing roller 40 from the target temperature is −40 degree C., and the air wind amount is 3 m^3/min, the temperature adjustment correction value is determined to be 10 degree C. from FIG. 7, and the temperature adjustment correction value is set to 15 degree C. from FIG. 6. Therefore, the target temperature of the external heating roller 53 is set to 225 degree C.

The controller 80 starts the air separating operation of the air separating unit 60 (S3) and waits for the temperature of the external heating roller 53 to reach the target temperature (No side of S4). When the temperature of the external heating roller 53 reaches the target temperature (Yes in the step S4), the controller 80 starts the sheet feeding to fix the toner image on the recording material (S5).

When the result of the discrimination is negative, that is, the non-necessity of the air separation of the next recording material (No in S1), the controller 80 discriminates whether or not the air separation is currently carried out (S6). When the discrimination is affirmative, that is, the air separating operation is carried out (Yes in S6), the recording material is fed to the heating nip N while keeping the air separation (S7), and simultaneously, the target temperature of the external heating roller is set to the target temperature of 200 degree C. (at the time of air stop) (S8).

Until the temperature of the external heating roller 53 reaches the target temperature, the controller 80 gradually reduces the flow rate of the air following the temperature drop of the external heating roller 53 in accordance with the table prepared from FIG. 6 (S9).

When the temperature of the separation air is 120 degree C., and the temperature difference of the fixing roller 40 from the target temperature is −40 degree C., the temperature adjustment correction value is 10 degree C. from FIG. 7. When the air wind amount is 3 m^3/min, the temperature adjustment correction value is 15 degree C. from FIG. 6. As shown in FIG. 6, the air wind amount and the temperature adjustment correction value of the external heating roller 53 are in the proportional interrelation, and therefore, 10 degree C+15 degree C=25 degree C. is deduced at the flow rate 3 m^3/min, the flow rate corresponding to the temperature of the external heating roller 53 is set by the following equation (S9).

Flow rate [m^3/min]=3[m^3/min]×(actual measurement of the outer heating temperature difference)/(sum of the temperature adjustment correction values).

For example, when the actually measured temperature of the external heating roller 53 in the process of temperature drop from 225 degree C. toward 200 degree C. is 205 degree C., and the actual measurement of the outer heating temperature difference is 5 degree C., the flow rate is set as follows:

Flow rate [m^3/min]=3[m^3/min]×5/(10+15)=0.25 [m^3/min].

In this manner, the flow rate of the air separating unit 60 is controlled every moment, by which when the temperature of the external heating roller 53 reaches the target temperature of 200 degree C., the flow rate is 0 [m^3/min] in accordance with the computational expression.

In the process of temperature drop of the external heating roller 53 from 225 degree C. to 200 degree C. while continuing the continuous sheet processing (S9), the controller 80 discriminates whether or not the kind of the recording material requires the air separation (S10). If the recording material still does not require the air separation (No in S10), the discrimination is made as to whether or not the temperature of the external heating roller 53 reaches the target temperature of 200 degree C. (S11). The setting of the flow rate is effected (S9) until the external heating roller 53 reaches the target temperature of 200 degree C. No in S11), and when the temperature of the external heating roller 53 reaches the target temperature of 200 degree C. (Yes in S11), the operation is switched to the normal operation (S12).

According to the temperature adjustment control of Embodiment 4, the continuous sheet processing can be continued without waiting for the temperature drop of the external heating roller 53, and since the flow rate of the air is decreased gradually, the glossiness and the fixing quality of the output image does not non-continuously changes during the transient period.

In order to confirm the effect of the temperature adjustment control of Embodiment 4, the fixing roller was controlled at 160 degree C., and comparative experiments were carried out with the image formation job of the one-side-printing continuous sheet processing for a combination of A4 size gloss coated paper sheets having a basis weight of 80 g/m^2 and gloss coated paper sheets having a basis weight of 157 g/m^2. As a comparison example for Embodiment 4, the air separation is always carried out at the air flow rate of 3 m^3/min (always operating case). Another comparison example (no temperature control case) is without the temperature control, in which the air separation is operated with the air flow rate of 3 m^3/min only for the gloss coated paper sheet having a basis weight of 80 g/m^2.

TABLE 2*

| | Embodiment 3 | Always ON | No temp. control |
|---|---|---|---|
| Heater ON-ratio (%) | G(65%) | F(80%) | G(55%) |
| Temp. rise of Main Assembly (degree C.) | G(95° C.) | NG (110° C.) | F(100 degree C.) |
| Glossiness difference (%) | G(5%) | G(5%) | NG(15%) |

G: good
F: fair
NG: no good

In Table 2, the heater-ON ratio is a ratio of the ON time of the lamp heater 53 to the execution time of the image formation job.

Heater-ON rate=heater-ON time/operation time.

The main assembly rising temperature is the maximum value of the detected temperature of the thermister (ambient condition sensor) S2 provided on the cover 44 of the fixing device 9, during the image formation job. The image glossiness difference is a variation of the glossiness (60 degrees reflectance of the monochromatic black image) obtained from the output image on the gloss coated paper having the basis weight of 80 g/m^2, using the air blowing, that is, Maximum value of the reflectance−minimum value of the reflectance.

As shown in Table 2, in Embodiment 4, the heater-ON ratio (electric energy consumption) is lower, and the temperature rise of the main assembly is suppressed as compared with the always operating case. In Embodiment 4, the heater-ON ratio slightly increases (slightly worsen from the standpoint of electric energy saving) as compared with the no temperature control case, but the temperature rise of the main assembly is suppressed, and the variation of the image glossiness is small.

In Embodiment 4, the minimum temperature of the fixing roller 40 through the image formation job is 155 degree C., and the maximum temperature is 163 degree C. Since the minimum temperature is not lower than 150 degree C., the variation in the glossiness does not appear. On the contrary, in the case of the no temperature control case, the minimum temperature of the fixing roller 40 through the image formation job is 144 degree C., and the maximum temperature is 160 degree C. Since the minimum temperature is lower than 150 degree C., the variation in the glossiness is large. In the case of the always operating case, the minimum temperature of the fixing roller 40 passage the image formation job is 154 degree C. and the maximum temperature is 161 degree C.

In the fixing device for fixing the toner on the recording material using the heat and pressure according to Embodiment 4, the execution of the air separation is minimized for the recording material not requiring the air separation from the fixing roller. In Embodiment 4, when the air separation is executed in the fixing device, the air is blown depending on the condition so that the constant glossiness feeling can be provided. By operating the air separation fan only when it is necessary, a reduction of the electric power for operation and a temperature rise prevention of the main assembly can be accomplished. By this, temperature rise prevention of the main assembly and the electric energy saving are accomplished. In addition, both of uniformation of the glossiness feeling of the prints and the separation performance are accomplished. Thus, the variation in the quality of the output image is decreased, and the electric energy consumption saving is accomplished, while suppressing the main assembly temperature rise.

The other experiments have been carried out using the other basis weights and other kinds of recording materials, and it has been confirmed that Embodiment 4 is particularly advantageous when the recording materials requiring the air separation and not requiring it are mixed.

Other Embodiments

In Embodiment 4, when the target temperature of the external heating roller 53 is high, the flow rate of the separation air is changed to accomplish uniformation of the glossiness. However, another method using cooling means, for example, may be used if the temperature of the fixing roller 40 can be substantially uniform during the image forming operation.

In Embodiment 4, the output of the lamp heater is controlled in accordance with the detected temperature of the thermister. However, by making the heat quantity controllable, the ON condition of the heating source may be controlled on the basis of the feeding position of the recording material and/or the timing of the image forming operation, or the output of the heating source may be changed depending on the voltage applied to the heating source.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 236151/2011 filed Oct. 27, 2011 which is hereby incorporated by reference.

What is claimed is:

1. An image heating apparatus comprising:

first and second rotatable members configured to heat a toner image on a recording material in a nip provided therebetween;

an external heating member configured to contact an outer surface of said first rotatable member to heat said first rotatable member;

a heater configured to heat said external heating member;

a detector configured to detect a temperature of said external heating member;

a controller configured to control said heater in accordance with an output of said detector so that said external heating member maintains a target temperature; and an air blowing device configured to blow air toward a position where the recording material is separated from said first rotatable member, wherein said controller controls the target temperature of said external heating member in accordance with information corresponding to a temperature of the air blown from said air blowing device.

2. An apparatus according to claim 1, further comprising a measuring device configured to measure elapsed time, as the information, from the start of operation of said image heating apparatus, wherein said controller controls the target temperature of said external heating member in accordance with an output of said measuring device.

3. An apparatus according to claim 2, wherein said controller sets the target temperature of said external heating member to a first target temperature when the elapsed time measured by said measuring device is not shorter than a predetermined time, and sets the target temperature of said external heating member to a second target temperature which is higher than the first target temperature when the elapsed time measured by said measuring device is shorter than the predetermined time.

4. An apparatus according to claim 1, further comprising an air temperature detector configured to detect a temperature, as the information, of the air blown by said air blowing device, wherein said controller controls the target temperature of said external heating member in accordance with an output of said air temperature detector.

5. An apparatus according to claim 4, wherein said controller sets the target temperature of said external heating member to a first target temperature when the temperature detected by said air temperature detector is not less than a predetermined temperature, and sets the target temperature of said external heating member to a second target temperature which is higher than the first target temperature when the temperature detected by said air temperature detector is less than the predetermined temperature.

6. An apparatus according to claim 1, further comprising a housing configured to accommodate said first rotatable member and said second rotatable member, wherein said air blowing device takes the air from said housing.

7. An apparatus according to claim 1, wherein said air blowing device further comprising a fan provided in said housing, and a nozzle configured to blow the air from said fan toward said first rotatable member.

8. An apparatus according to claim 1, wherein said air blowing device controls whether to blow the air toward the position depending on a kind of the recording material.

9. An apparatus according to claim 8, wherein said air blowing device controls whether to blow the air toward the position depending on a basis weight of the recording material.

10. An apparatus according to claim 9, wherein said air blowing device blows the air when the basis weight of the recording material is not more than a predetermined value, and does not blow the air when the basis weight of the recording material is more than the predetermined value.

11. An apparatus according to claim 1, further comprising a moving mechanism to move said external heating member to and from said first rotatable member, wherein said moving mechanism contacts said external heating member to said first rotatable member with the start of an image heating operation, and spaces said external heating member from said first rotatable member with completion of the image heating operation.

12. An apparatus according to claim 1, wherein said external heating member includes a hollow cylindrical base containing said heater, and a parting layer provided on said base, wherein said detector contacts said parting layer.

13. An apparatus according to claim 1, wherein said first rotatable member includes a hollow cylindrical base containing the heater, an elastic layer provided on said base, and a parting layer provided on said elastic layer.

* * * * *